United States Patent [19]

Satterfield

[11] Patent Number: 4,633,530

[45] Date of Patent: Jan. 6, 1987

[54] PROTECTIVE DEVICE

[76] Inventor: Roy E. Satterfield, 309 Oak Park Dr., Knoxville, Tenn. 37918

[21] Appl. No.: 772,321

[22] Filed: Sep. 4, 1985

[51] Int. Cl.[4] ..... A42B 1/06

[52] U.S. Cl. ..... 2/423; 2/209

[58] Field of Search ..... 2/423, 416, 209, 185 R, 2/199

[56] References Cited

U.S. PATENT DOCUMENTS

| | | | |
|---|---|---|---|
| 280,005 | 6/1883 | Beard et al. | 2/209 X |
| 869,401 | 10/1907 | Wells | 2/209 X |
| 1,635,916 | 7/1927 | Williams | 2/185 R |
| 2,185,043 | 12/1939 | Heilstedt et al. | 2/416 |
| 2,248,366 | 7/1941 | Lewis | 2/416 |
| 2,504,826 | 4/1950 | Goldman | 2/209 |
| 2,697,835 | 12/1954 | Stone | 2/199 |
| 2,704,367 | 3/1955 | Gellman | 2/199 |
| 3,128,474 | 4/1964 | Feldman | 2/199 |
| 3,497,874 | 3/1970 | Molitoris | 2/423 |
| 3,518,701 | 7/1970 | Fekete | 2/172 |
| 3,806,950 | 4/1974 | Spencer-Foote | 2/185 R |
| 4,091,469 | 5/1978 | Davidson | 2/423 X |

OTHER PUBLICATIONS

The *Game Room* Catalog, Fall/Winter, 1949–50, p. 30 (advertisement for a Hangover Hat).

*Primary Examiner*—Louis K. Rimrodt
*Attorney, Agent, or Firm*—Luedeka & Neely

[57] ABSTRACT

There is disclosed a protective device having a conventional hard hat and a pair of ear warmer pads. The pads are connected together above the top of the head of a wearer of the hard hat by a strap and are detachably attached together below the chin of the wearer. The hard hat comprises an outer protective shell, a support webbing and a support band. The webbing supports the shell on the head of the wearer to define a space between the shell and the head. By passing the strap through the space, and attaching the pads together beneath the chin, the pads are held against the ears and the hard hat is held on the head of the wearer. The pads are of a thickness such that they can be stored in the space between the shell and the head of the wearer, thus eliminating the necessity of having to remove the pads from the hard hat when the pads are not in use.

4 Claims, 7 Drawing Figures

BEST AVAILABLE COPY

PROTECTIVE DEVICE

The present invention relates to protective apparel for construction workers and the like, and more specifically relates to a head protector and ear warmer having ear warmer pads connected to hold a hard hat on the head of a wearer and which are storable within a space between the hard hat and the head of the wearer.

Most construction workers are now required to wear a form of head protector known as a hard hat while they are exposed to a danger of being struck from above by falling objects. These hats take on a variety of shapes, and variations are known to exist in the support structure used to support the hat on the head of a wearer. But the majority of such hats incorporate with an outer protective shell, a support webbing of some sort and a support band.

In cold weather, workers who are required to wear these hats often lack adequate thermal protection for their ears. While some wear what is commonly referred to as a hard hat "liner", there are a number of difficulties with such a device. One problem with liners is that they require adjustment of the support band when they are attached to the hat, and readjustment when they are removed. Liners also usually cover the entire head and ears which may not be desirable in some cases. And since the liners are generally attached to the hat in some way, the wearer is not able to adjust the position of the hat independently of the position of the liner. Moreover, because the liners are between the support band of the hat and the head of the wearer, they cause a feeling of insecurity an unwieldiness on the part of the wearer.

Accordingly, there exits a need for a hard hat and ear warmer arranged and constructed in such a manner as to provide ear warmth for the wearers of hard hats in cold weather, without requiring repeated adjustment of the support band, which enhances rather than detracts from the feeling of security, and which allows for independent movement of the hard hat. A further need exists for a protective device which also incorporates the concept of storageability of the ear warmers without disturbing the normal use of the hard hat.

The present invention meets these needs and therefore solves the foregoing and other problems long associated with protective devices of this type by providing an ear warmer and head protector device which is arranged and constructed so as not to interfere with normal use of the hard hat and which increases the feeling of security on the part of the wearer.

In accordance with the present invention a protective device for providing ear warmth and head protection to construction workers and the like is provided having a hard hat for being worn on the head of a wearer which has an impact resistant protective shell and support webbing located within the shell for supporting the shell on the head of the wearer to define a space between the shell and the head of the wearer. The hard hat also has an adjustable support band connected to the shell which supportingly engages and surrounds the head of the wearer. A pair of ear warmer pads are dimensioned to substantially cover each ear of the wearer and each of the pads comprises a soft material having insulating properties and an outer surface. The pads have a thickness approximating the distance between the support band and the shell, whereby the pads, when not disposed to cover the ears of the wearer, can be stored in the space between the shell and the head of the wearer and be held within the space by the engagement of the outer surfaces of the pads against the shell and the webbing. A strap connects the ear warmer pads so that each of the pads depends from a point adjacent the support band of the hard hat when the pads are disposed to cover the ears of the wearer. Structure is provided for detachably attaching the ear warmer pads together beneath the chin of the wearer to hold the ear warmer pads against the ears of the wearer.

In accordance with another aspect of the present invention the strap extends from one of the ear warmer pads to the other ear warmer pad and is located about the head of the wearer around the support webbing and band so that when the ear warmers are attached together beneath the chin of the wearer, the strap engages the head of the wearer to hold the hard hat on the head of the wearer.

In accordance with yet another aspect of the invention the strap is elastic and is located in the space between the head of the wearer and the shell so that when the strap engages the head of the wearer it engages the support webbing to hold the hard hat on the head of the wearer.

The advantages and further aspects of the present invention will be readily appreciated by those of ordinary skill in the art as the same becomes better understood by reference to the following detailed description when considered in conjunction with the accompanying drawings in which.

Figure 1:
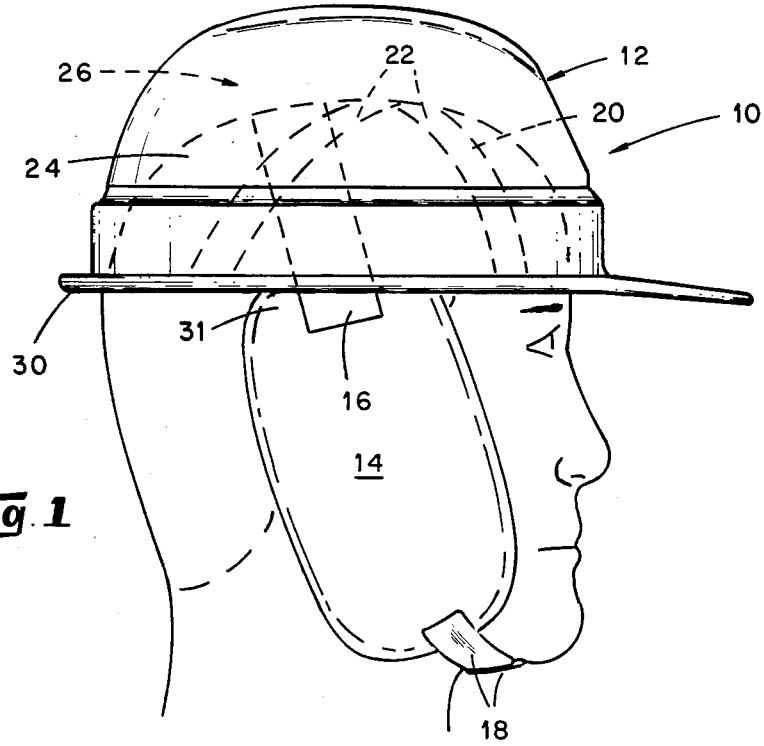
FIG. 1 is a side view of a protective device illustrating a hard hat and one of a pair of ear warmer pads.
Figure 2:
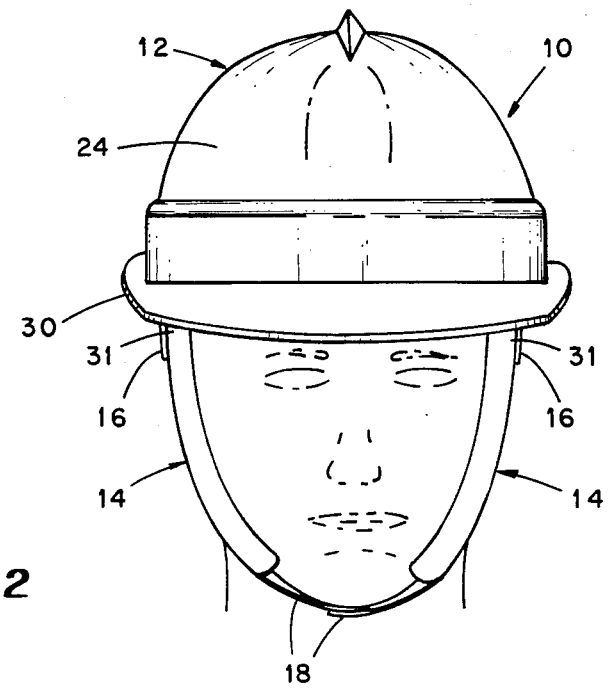
FIG. 2 is a front view of the protective device illustrating the orientation of each of the ear warmer pads and their connection beneath the chin of the wearer.
Figure 3:
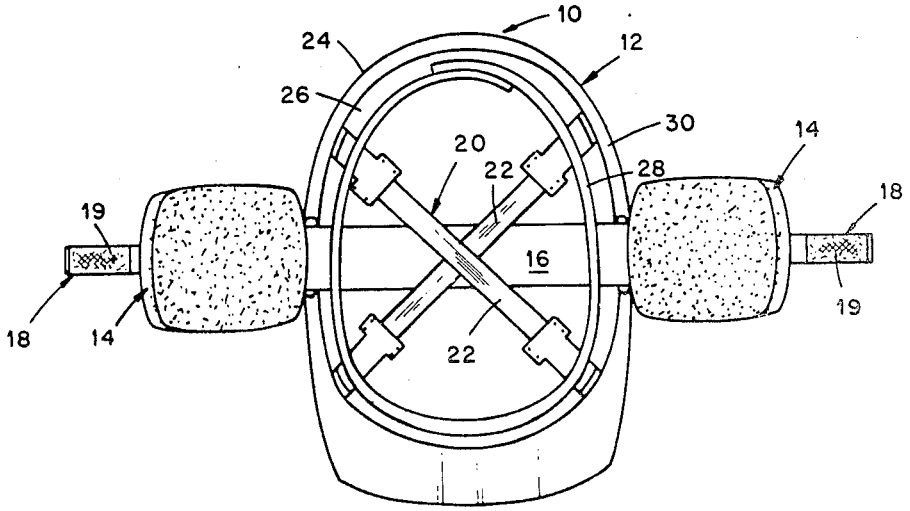
FIG. 3 is a view of the hard hat from the bottom illustrating a strap connecting the ear warmer pads and the placement of the strap relative to a support band and support webbing within the hard hat.

Referring now to the drawings in which like reference characters refer to like or similar parts throughout the several views, there are shown in FIGS. 1 through 3 various aspects of a preferred embodiment of the present invention. A protective device 10 is illustrated being worn by a wearer and comprises a conventional-type hard hat 12 and a pair of ear warmer pads 14. A preferred means for connecting the pads 14 is provided by a strap 16 extending from one of the ear warmer pads 14 over the top of the head of the wearer to the other ear warmer pad 14. And a preferred means for detachably attaching the ear warmer pads 14 together below the chin of the wearer is provided by chin straps 18. The chin straps 18 are preferably configured with hook and loop fastener strips 19 formed from a synthetic material such as the product sold under the trademark VELCRO so they can be adjustably joined together beneath the chin.

Referring specifically to FIG. 3, the hard hat 12 is illustrated comprising a support webbing 20 which is suitably provided by a pair of crossed straps 22. The crossed straps 22 are connected to an impact resistant protective shell 24 in any convenient manner to provide a recessed area within the shell 24 so that the shell fits down over and substantially covers the upper hemisphere of the head of the wearer. The support webbing 20 is also arranged so that when the shell 24 is supported on the head of the wearer, a space 26 is defined between the shell 24 and the enclosed hemispherical portion of the head of the wearer. An adjustable support band 28 is suitably attached to the shell 24 either by direct attachment or by attachment to the crossed straps 22 as shown in FIG. 3. The support band 28 is located adjacent a lower rim 30 extending around the bottom of the shell 24 and supportingly engages and surrounds the head of the wearer. The space 26 will ordinarily be of varying dimensions with the part of the space 26 directly above the head of the wearer between the shell 24 and the head surface being about two inches, and the part of the space 26 between the head surface adjacent the band 28 and the shell 24 being about one half to one inch.

Figure 4:
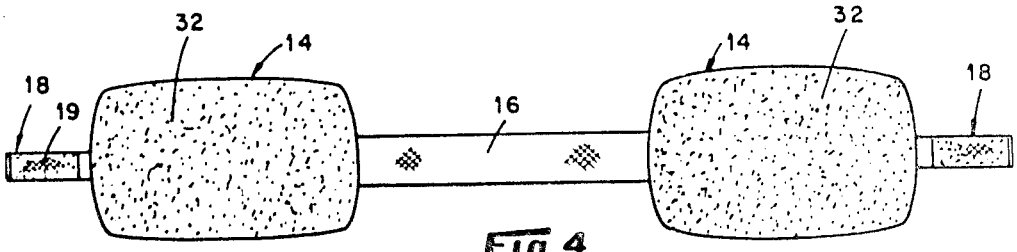
FIG. 4 is an illustration of the ear warmer pads and strap removed from the hard hat.

Referring to FIGS. 3 and 4, the length of the strap 16 is sufficient so that the strap 16 can be positioned in the space 26 between the head of the wearer and the shell 24 and allow the upper ends 31 of the pads 14 to be adjacent the support band 28. As shown in FIGS. 1 and 2, the strap 16 will support the pads 14 so that each of the pads 14 depends from a point adjacent the band 28 of the hard hat 12 when the pads 14 are disposed to cover the ears of the wearer. One important advantage of the present invention is illustrated when the strap 16 is located about the head of the wearer as shown in FIG. 1 and is in the space 26 between the webbing 20 and the shell 24 (the strap 16 also can be positioned between the band 28 and shell 24 as shown in FIG. 3). It will be appreciated that in this arrangement, attaching the chin straps 18 together to hold the pads 14 against the ears of the wearer causes the strap 16 to be pulled against the top of the head of the wearer. Since the band 28 and webbing 20 are between the strap 16 and the head of the wearer, the hard hat 12 is held in place when the strap 16 is tightened by attaching the chin straps 18 together. Comfort and security are enhanced if the strap 16 is elastic since movement of the chin of the wearer relative to the hard hat and adjustment of the tightness of the strap 16 is facilitated. Also, since the strap 16 is not between the band 28 or the webbing 20 and the head of the wearer, the hard hat 12 can rest directly on the head surface. This eliminates the unwieldy position of hard hats which employ liners that are between the webbing or band and the head. And since neither the strap 16 nor the pads 14 are connected to the hard hat 12, the position of the hat 12 can be adjusted independently of the pads 14, and vice versa.

Figure 5:
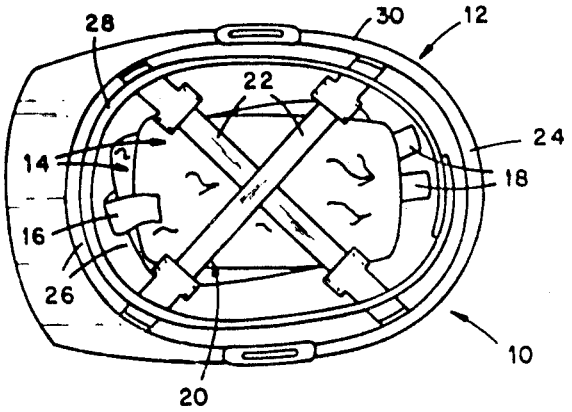
FIG. 5 is a view of the hard hat from the bottom illustrating storage of the ear warmer pads within a space between the support webbing and the support band, and a protective shell portion of the hard hat.

With reference now to FIGS. 4 and 5, in conjunction with FIGS. 1 and 2, the ear warmer pads 14 preferably comprise a soft material having insulating properties sufficient to protect against significant heat loss from the ears during cold weather. Each pad 14 has an outer surface 32, at least one side of which should be compliant for engaging the contours of the ears of the wearer. Such a construction is accomplished, for example, by applying a heavy napped cotton or synthetic fabric over a foam pad. Or the entire pad 14 itself may be constructed of cotton or other fibers in such a manner as to define a pad 14 having the characteristics described herein. Precaution should be used in the selection of material for the pads to ensure that normal hearing is not significantly impaired. This consideration becomes especially relevant in heavy construction areas and around roads and highways where there is a need to be alert to horns, buzzers, whistles and the like.

Another aspect of the present invention involves the use of a fluorescent coloring on the pads 14. The coloring makes it easier for the wearer to be seen at night which would be useful for workers near roads and highways.

As best shown in FIGS. 1 and 2, the pads are elongate and have a width sufficient to cover an ordinary ear from front to back and have a length sufficient to cover the ear from top to bottom regardless of any variation expected in the size of the head of the wearer. The elasticity of the strap 16 will also aid in compensating for variations in the length or position of the wearers' ears making it possible to pull the pads 14 farther up, depending on the situation.

Another important advantage of the invention is illustrated in FIG. 5. There, the pads 14 are shown stored in the space 26 between the webbing 20 and the band 28, and the shell 24. This storageability aspect of the invention is facilitated by the thickness of the pads 14 which is sufficient to ensure that the pads 124 are held within the space 26 as outer surface 32 of the pads 14 engages the shell 24, the webbing 20 and the band 28. Ordinarily, based on the dimensions of the space 26 as discussed above, the thickness of the pads 14 will be in the neighborhood of one inch which approximates the dimension of the space 26 between the band 28 and the shell 12. This will prevent the pads 14 from slipping through the part of the space 26 between the band 28 and the shell 12 and provide enough bulk to keep the pads 14 from moving around in the part of the space 26 between the webbing 20 and the shell 12. The pads 14 are usually placed in storage as shown in FIG. 5 by first pushing the ends of the pads 14 having extending therefrom the chin straps 18 into the area of the space 26 between the band 28 and the shell 24. Continued urging of the pads 14 into this area causes the pads 14 to move along the concavity of the inner surface of the shell 24 in a direction such as that shown in FIG. 5 until the pad 14 is substantially within the space 26. When stored in this way, the pads 14 are either hidden from outside view or are barely visible and offer no interference with the normal use of the hard hat 12. When it is desired to use the pads 14 again for covering the ears, they can easily be removed from the space 26 by pushing them back through the area of the space 26 between the band 28 and the shell 24 and re-attaching the chin straps 18. Thus, it is seen that the wearer need not remove the strap 16 from its position in the space 26 to store the pads 14. And the pads 14 can be stored in this manner either by a stacking arrangement such as shown in FIG. 5 or by slipping the pads 14 into the space 26 with a partial overlap, or by positioning the pads 14 flat against the inside surface of the shell 24 without an overlap, depending on dimensional allowances and constraints.

Figure 6:
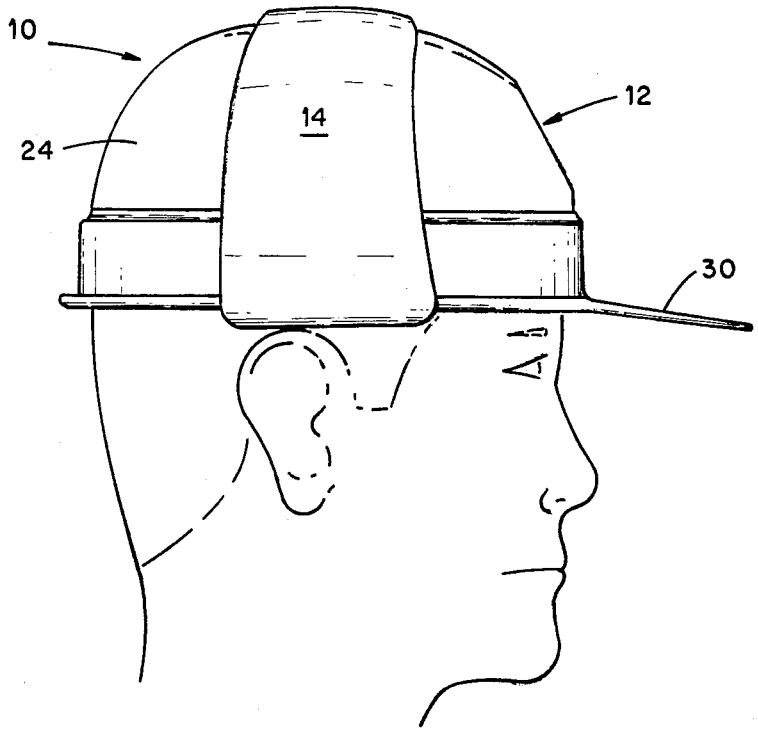
FIG. 6 is a side view of the protective device illustrating attachment of the ear warmer pads together above the hard hat when the pads are not in use.
Figure 7:
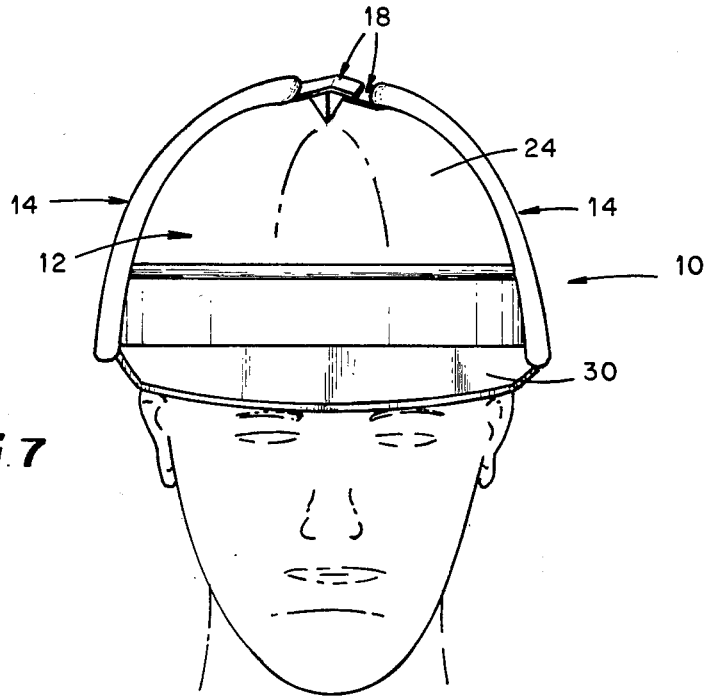
FIG. 7 is a front view of the protective device in the configuration shown in FIG. 6.

Referring now to FIGS. 6 and 7, the ear warmer pads 14 are shown attached together adjacent the apex of the hard hat 12. This method of storage is accomplished by simply connecting the chin straps 18 together at this position, the circumferential dimension of the shell 24 from side to side being about the same as the combined length of the two pads 14 and chin straps 18 when the pads 14 are connected together beneath the chin of the wearer so that the chin straps 18 will meet at the apex in a suitable manner for attachment together. The pads 14 can then be reattached beneath the chin of the wear by detaching the chin straps 18 and reattaching them in the desired position. Thus, it is seen that this method of storage provides a quick and easy method of securing the pads 14 away from the ears of the wearer without removing the hard hat 12, providing a means for rapid reattachment of the chin straps 18 together to reposition the pads 14 against the ears of the wearer.

The strap 16 and chin straps 18 shown in the various figures can be secured to the pads 14 in any convenient manner such as by sewing or by adhesive. The chin straps 18 can also be formed by extending the strap 16 across an outer surface of each pad 14 and having an appendage from each pad 14 to serve as a chin strap 18. Thus, it is realized that a number of possible variations in the manner of attaching and locating the ear warmer pads 14 are possible and it is not intended that the scope of the invention be limited by any such arrangement. Many other aspects of the device 10 as described above such as the spacing or location of the cross straps 22 to form the support webbing 20, or the support band 28, are of a conventional type and therefor subject to many possible variations depending on design exigencies and so forth. Accordingly, although particular embodiments of the present invention have been described in the foregoing detailed description it will be understood that the protective device 10 is capable of numerous rearrangements, modifications and substitutions of parts without departing from the scope of the invention as set forth in the claims below.

What is claimed is:

1. A protective device for providing ear warmth and head protection to construction workers and the like, comprising:

a hard hat for being worn on the head of a wearer, said hard hat having an impact resistant protective shell and support webbing disposed within said shell for supporting said shell on the head of the wearer and to define a space between said shell and the head of the wearer, and having an adjustable support band connected to said shell to supportingly engage and surround the head of the wearer;

a pair of ear warmer pads dimensioned to substantially cover each ear of the wearer, each of said pads being elongate and having a width sufficient to cover an ear from front to back and comprising a soft material having insulating properties and an outer surface, and having a thickness approximately the distance between said support band and said shell whereby said pads, when not disposed to cover the ears of the wearer, can be stored in said space between said shell and the head of the wearer and be held within said space by the engagement of said outer surfaces of said pads against said shell and said webbing;

means for connecting said ear warmer pads so that each of said ear warmer pads depends from a point adjacent the support band of said hard hat when said pads are disposed to cover the ears of the wearer; and means for detachably attaching said ear warmer pads together beneath the chin of the wearer to hold said ear warmer pads against the ears of the wearer;

said means for connecting said ear warmer pads together so that each of said ear warmer pads depends from a point adjacent the support band of said hard hat when said pads are disposed to cover the ears of the wearer comprising a strap extending from one of said ear warmer pads to the other ear warmer pad, said strap being located about the head of the wearer relative to said support webbing and said band so that when said ear warmers are attached together beneath the chin of the wearer, said strap engages said support webbing and said band to hold said hard hat on the head of the wearer.

2. The protective device of claim 1, wherein said strap is elastic so that movement of the chin of the wearer relative to said hard hat and adjustment of the tightness of said strap is facilitated.

3. In an ear warmer for being worn with a head protector which has an outer protective shell and a support webbing for supporting the head protector on the head of a wearer to define a space between the shell and the head of the wearer, and a support band connected to the shell to supportingly engage and surround the head of the wearer, the improvement comprising:

a pair of ear warmer pads dimensioned to substantially cover each ear of the wearer, each of said ear warmer pads being elongate and having a width sufficient to cover an ear from front to back, and having a length sufficient to provide coverage of an ear from the top to the bottom regardless of any variation expected in the size of the head of the wearer, each of said pads being constructed of a soft material having insulating properties and an outer surface, and having a thickness approximately the distance between the support band and the shell whereby said pads, when not disposed to cover the ears of the wearer, can be stored in the space between the shell and the head of the wearer and be held within the space by the engagement of said outer surfaces of said pads against the shell and the webbing;

a strap for connecting said ear warmer pads together, said strap being disposed to pass between the webbing of the head protector and the outer protective shell of the head protector so that each of said ear warmer pads depends from a point adjacent the support band of the head protector when said pads are disposed to cover the ears of the wearer; and means for detachably attaching said ear warmer pads together beneath the chin of the wearer to hold said ear warmer pads against the ears of the wearer, whereby attaching said ear warmers together causes said strap to engage the webbing to hold said head protector on the head of the wearer.

4. The ear warmer of claim 3, wherein said strap is elastic and extends from one of said ear warmer pads to the other ear warmer pad, said strap being located about the head of the wearer relative to the support webbing and the band so that when said ear warmers are attached together beneath the chin of the wearer, said strap is pulled against the support webbing to hold the head protector on the head of the wearer.

* * * * *